United States Patent [19]

Noack et al.

[11] 4,149,354

[45] Apr. 17, 1979

[54] SHRINK WRAPPING APPARATUS

[76] Inventors: Fritz Noack, Ganghofer Str. 12, 8942 Ottobeuren; Rolf Wenger, Nordweg 9, 8944 Grönenbach, both of Fed. Rep. of Germany

[21] Appl. No.: 854,017

[22] Filed: Nov. 22, 1977

[30] Foreign Application Priority Data

Nov. 25, 1976 [DE] Fed. Rep. of Germany ..... 2653464

[51] Int. Cl.[2] ..... B65B 53/06; B65B 57/10

[52] U.S. Cl. ..... 53/52; 34/54; 34/222; 53/557

[58] Field of Search ..... 53/52, 184 S, 30 S; 34/54, 212, 216, 217, 222, 225, 229; 219/388 C

[56] References Cited

U.S. PATENT DOCUMENTS 3,673,703 7/1972 Wieligmann ..... 53/184 S

FOREIGN PATENT DOCUMENTS 2447016 8/1974 Fed. Rep. of Germany ..... 53/184 S

*Primary Examiner*—Robert Louis Spruill

*Attorney, Agent, or Firm*—Haseltine, Lake & Waters

[57] ABSTRACT

Shrink wrapping apparatus including a hot air circulation system having a stand-by circuit and an operating circuit. A movable control plate switches from one circuit to the other dependent on the existence of an article the envelope of which is to be shrunk. The operating circuit is provided with a retaining chamber which is open at the front side of the apparatus and can only be covered by an article. A hot air recovery system is provided for collecting the hot air leak streams in the neighborhood of the opening of the retaining chamber.

7 Claims, 4 Drawing Figures

SHRINK WRAPPING APPARATUS

A conventional shrink wrapping apparatus, in general comprises a housing in which a hot air circulation system is provided. The front side of the housing has an opening, which can be closed by a door or displaceable plate. A conveyor is arranged adjacent said opening so that objects provided with a taut envelope of a thermoplastic film material having laterally projecting portions can be moved in a position in front of the opening. The door then is opened and hot air is delivered to the side wall of the subjects so that the projecting film portions are melted and shrunk tight at the sideface of the objects. Then the objects are moved forward and the opening of the housing is closed again.

It is an object of the invention to provide a shrinking apparatus which is more effective in operation and can be produced with lower costs. A further object is to provide a shrinking apparatus which is provided with a recovery system for thermal energy.

The novel shrinking apparatus, in brief, comprises a housing, a hot air circulation system within said housing a retaining or damming chamber the inlet of which being connected to the pressure side of the hot air circulation system, a front opening of the retaining chamber adjacent the moving path of the objects carried on a conveyor at one side of the housing, the front opening being at least partly coverable by the plurality of subjects enclosed by said shrink material, a collecting funnel means outside of the housing and arranged above the moving path of the objects, the collecting funnel being connected to the suction side of the hot air circulation system by an inlet opening provided in a wall of the housing, a by-pass channel within said housing short circuiting the pressure side of the hot air circulation system with the suction side of which and a switch plate within said housing, the switch plate having two positions, in one of which the inlet of the retaining chamber being closed and the by-pass channel being opened and in the other position the by-pass channel being closed and the inlet of the retaining chamber being opened.

A better understanding of the apparatus of the invention will be gained by reference to the following more detailed description and to the attached drawings.

Figure 3:
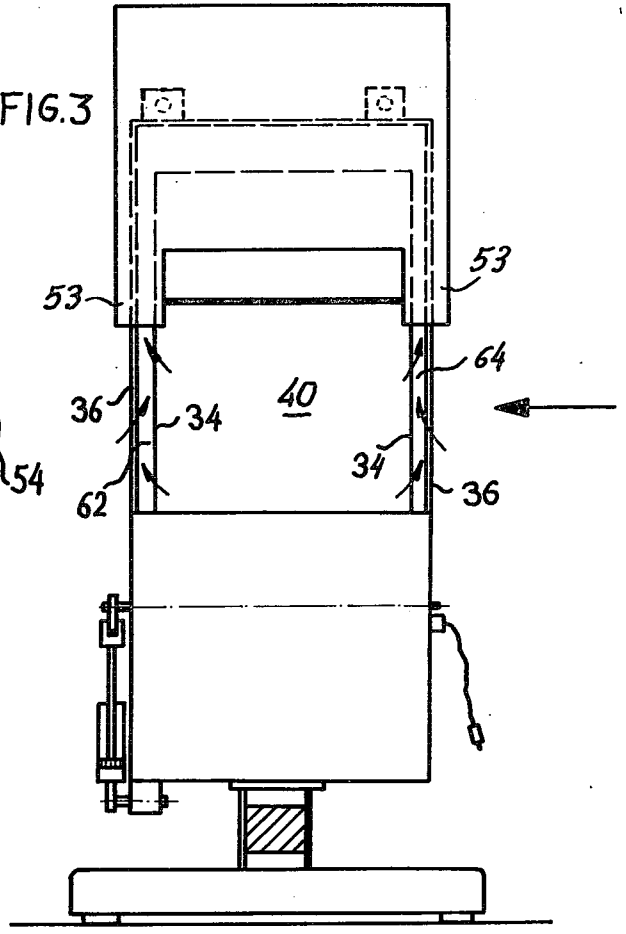
FIG. 3 is a front elevation view of the apparatus of FIG. 1 showing the apparatus in stand-by position and FIG. 4 is a front elevation view similar to FIG. 3 showing the novel apparatus behind the conveyor.

The side shrinking apparatus comprises a housing 10, the lower portion of which has a prismatic shape, the cross-section of which is reduced in the middle and upper portion by an inclined back wall 12. In the lower portion of the housing 10 a hollow body 14 is arranged around which the hot air is circulated when the apparatus is in the stand-by position as shown by the arrows in FIG. 1. Beneath the hollow body 14 a fan 16 is arranged upstream of which an electric heating device 20 is provided between the hollow body 14 and a front wall 18 of the housing. A control plate 22 pivotably mounted about a horizontal axis 24 closes in its horizontal position (FIG. 1) the vertical flow channel above the heating device and deflects the air stream via a by-pass opening in a short-circuit flow to a suction channel 26 provided adjacent the back wall 12.

A vertical intermediate wall 28 is provided above and substantially in the vertical plane of the swinging axis 24 of the control plate 22. This wall 28 forms the back wall of a retaining or damming chamber 30 defined at its upper end by a baffle plate 32 and laterally by side walls 34, 34 which are spaced from side walls 36 of the housing respectively. The retaining chamber 30 is open at its lower end and connected with the vertical channel 38 formed between the front wall 18 and the intermediate wall 28, which in turn is closed (FIG. 1) by the control plate 22. The retaining chamber 30 has a front opening 40 which is permanently open and can only be covered by the side walls of subjects or articles wrapped with the film to be shrunk.

The baffle plate 32, a roof-like or funnel shaped air collecting cap 42 projecting from the front wall plane of the housing and a front wall portion 44 are arranged at a vertically adjustable front structure, which is movably guided at the housing 10 and can be fixed by a screw 49. The front structure 46 is adjusted with respect to the height of the subjects P so that the front opening 40 corresponds to the height of the articles P.

The inclined projecting cap 42 defines together with the front edge of the baffle plate 32 a horizontal inlet opening 48 which is connected via a connection opening 49 in the front structure 46 with a vertical upper channel 50 extending between the front wall portion 44 and an upper extension of the intermediate wall 28, the upper edge of which being spaced from the upper wall of the housing, which in turn is associated with the back wall 12 of the housing. So a flow connection is provided between the vertical front channel 50 and the suction channel 26.

An article P is delivered on a conveyor 52 from an apparatus B in which the article is provided with an envelope of thermoplastic film material having projecting film portions 54 on both opposite sides. At each side of the conveyor a side shrinking apparatus is positioned. The front walls 18 of the pair of shrinking apparatus facing one another and mounted such that the space between the front walls is substantially equal with the width of the article P.

Figure 2:
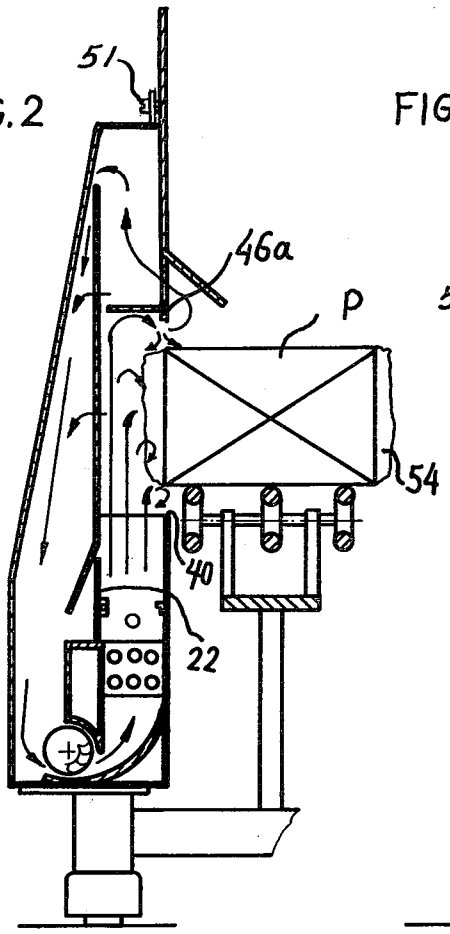
FIG. 2 is a side elevation view similar to FIG. 1 but showing the apparatus in its operation position, in which the by-pass channel is closed and hot air is delivered to the envelope surrounding the subjects.
Figure 1:
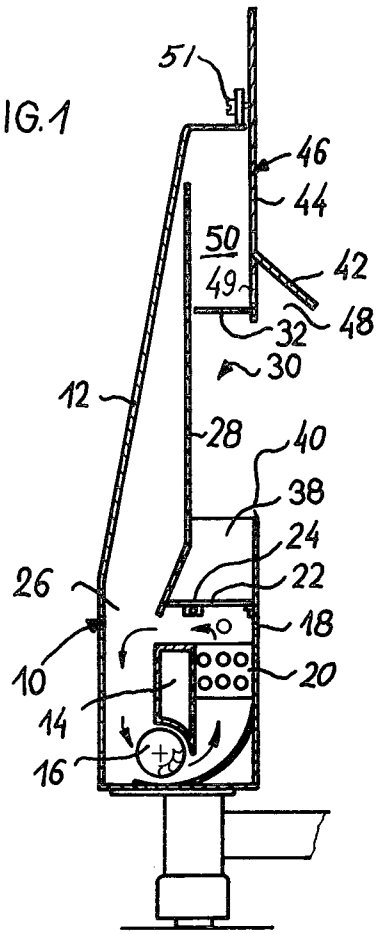
FIG. 1 is a side elevation view of the novel shrink wrap apparatus showing the hot air circulation system with short circuit flow of the hot air.
Figure 4:
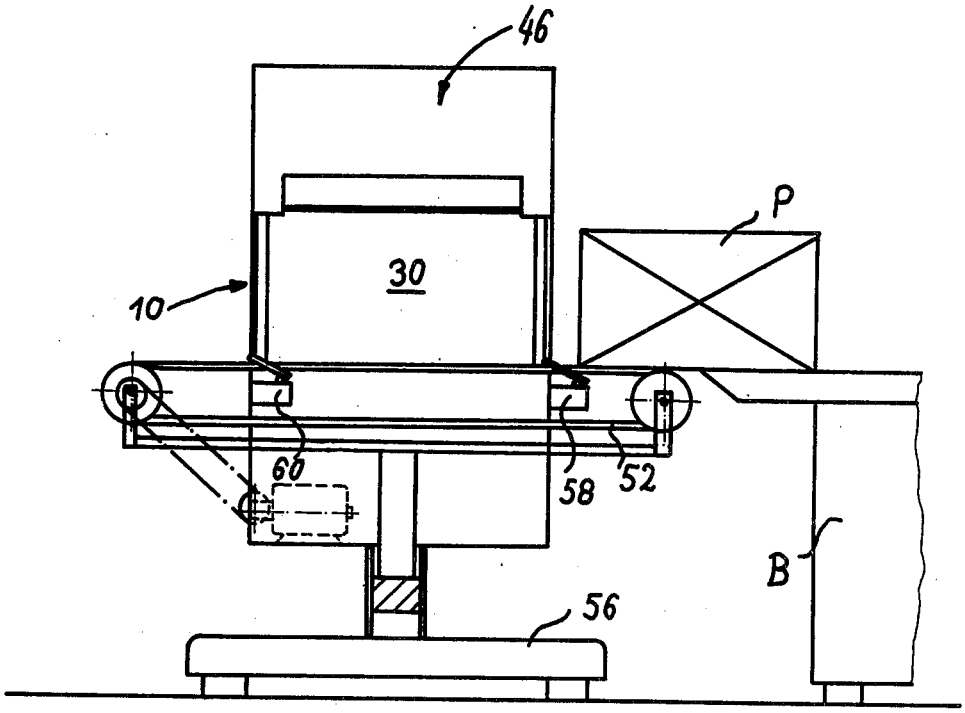

The conveyor consists of a plurality of belts between which control switches 58 and 60 are arranged in the inlet region and in the outlet region of the shrinking apparatus respectively. The switches project into the moving path of the articles so that the leading edge of the article operates the switch 58 which actuates a not shown motor to swing the control plate 22 into its vertical position 22'. Thereby the stand-by circuit of the hot air according to FIG. 1 is interrupted, the vertical channel 38 is opened and hot air flows into the retaining chamber 30. The air flow impacts against the baffle plate 32 and a turbulence is generated having no characteristic or main flow direction but is divided into a multiplicity of individual streams having different directions (see arrows in FIG. 2). A front plate extension **46*a* extends downwardly from the baffle plate 32** in order to assist the turbulence generation.

The front opening 40 now is covered by the side wall of the article. The hot air in the retaining chamber 30 contacts the whole side face of the article P at the same time. Also the edge regions are effectively heated so that the projecting film portions 54 are uniformly shrunk and form a ring shaped tightened side wall.

During the film shrinking process heat air particles flow out of the front opening 40 at the edges of the article but these leak streams are only of very small velocity because of the turbulence generation in the retaining or damming chamber 30. In order to recover these leak streams of hot air a recovery system is provided which comprises the upper suction cap or hood 42 and additional side suction slots 62, 64 which are formed between the side walls 34 of the retaining chamber 30 and the side walls 36 of the housing respectively. The upper suction cap and the pair of side suction slots 62, 64 are connected to the suction channel 26. The front structure 46 is provided with lateral cover portions 53 covering the suction slots 62, 64 above the height of the articles. Because of this very effective recovery system almost the whole hot air having been escaped from the retaining chamber is fed back into the housing. Therefore the new apparatus operates with only a very low heat loss.

The end switch 60 is operated by the article P when the article is moved forward and the control plate 22 is pivoted into its stand-by position so that the hot air can no longer flow into the chamber 30.

The conveyor can be permanently moved with constant speed and the switches 58, 60 co-operate with time-lag relays in order to assure that the heat shrinking process begins and ends at time points which best effects. Therefore also articles having a longitudinal dimension greater than the width of the front opening 40 of the housing can be handled. If articles of less or greater height are to be handled, then the front structure 46 is lowered or lifted. If articles of a greater width are to be handled it is only necessary to displace the frames 56 of the pair of shrinking apparatus such that the extension of the intermediate space is equal with said width of the articles.

What we claim is:

1. A shrink wrapping apparatus for heat shrinking thermoplastic shrink material enclosing a plurality of objects, advancing on a conveyor comprising: a housing; a hot air circulation system within said housing; a retaining chamber the inlet of which being connected to the pressure side of a hot air circulation system; a front opening in the retaining chamber adjacent the moving path of the objects carried on said conveyor disposed at one side of the housing; the front opening being at least partly coverable by the plurality of objects enclosed by said shrink material; a collecting funnel means outside of the housing and arranged above the moving path of the objects, the collecting funnel being connected to the suction side of the hot air circulation system by an inlet opening provided in a wall of the housing: a by-pass channel within said housing, short-circuiting the pressure side of the hot air circulation system with the suction side thereof, a switch plate within said housing, the switch plate having two positions, one of which the inlet of the retaining chamber being closed and the by-pass channel being opened and in the other position, the by-pass channel being closed and the inlet of the retaining chamber being opened and means responsive to the presence of the objects for shifting said switch plate.

2. A shrink wrapping apparatus as claimed in claim 1, wherein; control switches are arranged in the moving path of the objects carried on the conveyor, for operation by said objects in order to shift the switch plate from one position into the other.

3. A shrink wrapping apparatus as claimed in claim 1, wherein; the retaining chamber is defined by vertical side walls spaced from the side walls of the housing respectively, side chambers are formed between each pair of spaced side walls and connected with the suction side of the hot air circulation system, the side chambers having vertical openings adjacent both sides of the front opening of the retaining chamber.

4. A shrink wrapping apparatus as claimed in claim 1, wherein; the retaining chamber is formed in a vertical channel defined by a back wall, said pair of side walls and an upper baffle plate.

5. A shrink wrapping apparatus as claimed in claim 4, wherein: a channel connecting means is formed between the back wall of the retaining chamber and a back wall of the housing the collecting funnel with the suction channel of the hot air circulation system.

6. A shrink wrapping apparatus as claimed in claim 1, wherein; the collecting funnel and the retaining plate are arranged at a vertically adjustable front structure.

7. A shrink wrapping apparatus as claimed in claim 6, wherein: the vertically adjustable front structure is provided with lateral cover portions covering suction slots of side chambers provided adjacent the retaining chamber respectively, said side chambers being connected with the suction side of the hot air circulation system.

* * * * *